US008790080B2

(12) United States Patent
Gonoor et al.

(10) Patent No.: US 8,790,080 B2
(45) Date of Patent: Jul. 29, 2014

(54) TURBINE CASING HAVING LEDGE RING PARTITION APERTURE

(75) Inventors: Rajendra Gonoor, Bangalore (IN); Erik Eduardo Lopez Partida, Clifton Park, NY (US); Daniel Ross Predmore, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 612 days.

(21) Appl. No.: 13/102,647

(22) Filed: May 6, 2011

(65) Prior Publication Data

US 2012/0282083 A1 Nov. 8, 2012

(51) Int. Cl.
*F01D 25/24* (2006.01)

(52) U.S. Cl.
USPC ..... 415/221; 415/214.1

(58) Field of Classification Search
CPC ..... F01D 25/24
USPC ..... 415/213.1, 214.1, 220, 221
See application file for complete search history.

(56) References Cited

U.S. PATENT DOCUMENTS

| | | | | |
|---|---|---|---|---|
| 3,892,500 | A * | 7/1975 | Miller et al. | 415/213.1 |
| 4,102,598 | A * | 7/1978 | Stock et al. | 415/135 |
| 4,333,309 | A * | 6/1982 | Coronel | 60/39.093 |
| 7,497,658 | B2 * | 3/2009 | Bracken et al. | 415/134 |
| 2010/0202879 | A1 | 8/2010 | Agara et al. | |
| 2010/0303619 | A1 | 12/2010 | Predmore et al. | |

* cited by examiner

*Primary Examiner* — Ninh H Nguyen
(74) *Attorney, Agent, or Firm* — Hoffman Warnick LLC; Ernest G. Cusick

(57) ABSTRACT

A turbine casing segment is disclosed. In one embodiment, a turbine casing segment is disclosed including: a plurality of stage segments; a plurality of ledge ring partitions separating the plurality of stage segments, wherein at least one of the plurality of ledge ring partitions has an axially extending aperture therethrough; and a substantially rounded extraction aperture located flush with an inner surface of one of the plurality of stage segments.

15 Claims, 3 Drawing Sheets

TURBINE CASING HAVING LEDGE RING PARTITION APERTURE

BACKGROUND OF THE INVENTION

The subject matter disclosed herein relates to a turbine casing. Specifically, the subject matter disclosed herein relates to a steam turbine casing including a ledge ring partition aperture (or, cutout), allowing for a flush interface between an extraction conduit and a ledge ring.

Conventional turbine casing segments (e.g., in low-pressure, or LP, steam turbine casing segments) include built-up interfaces, commonly referred to as extraction boxes, for connecting extraction conduits to the casing segment. Typically, each extraction conduit has a wider diameter than the axial length of its respective turbine stage. The extraction box provides an interface between the wider extraction conduit and the narrower turbine stage casing segment, such that a desired amount of working fluid (e.g., steam) may be extracted from the desired stage of the turbine.

In some turbine applications, incorporating extraction boxes into the turbine casing may be impracticable. For example, in some cases, extraction boxes may occupy an undesirable amount of space in the casing segment, and may complicate the fabrication of the casing segment.

BRIEF DESCRIPTION OF THE INVENTION

A turbine casing segment is disclosed. In one embodiment, a turbine casing segment is disclosed including: a plurality of stage segments; a plurality of ledge ring partitions separating the plurality of stage segments, wherein at least one of the plurality of ledge ring partitions has an axially extending aperture therethrough; and a substantially rounded extraction aperture located flush with an inner surface of one of the plurality of stage segments.

A first aspect of the invention includes a turbine casing having a plurality of stage segments; a plurality of ledge ring partitions separating the plurality of stage segments, wherein at least one of the plurality of ledge ring partitions has an axially extending aperture therethrough; and a substantially rounded extraction aperture located flush with an inner surface of one of the plurality of stage segments.

A second aspect of the invention includes a turbine casing segment having: a plurality of stage segments; a plurality of ledge ring partitions separating the plurality of stage segments, wherein a first one of the plurality of ledge ring partitions has an axially extending aperture therethrough; an extraction aperture fluidly connected with an inner surface of one of the plurality of stage segments proximate to the axially extending aperture; and an extraction conduit fluidly connected with the extraction aperture, wherein the extraction conduit and the extraction aperture share a substantially identical inner diameter throughout a length of the extraction conduit.

A third aspect of the invention includes a turbine casing having: an upper casing segment; and a lower casing segment coupled to the upper casing segment, the lower casing segment including: a plurality of ledge ring partitions defining a plurality of stage segments, wherein at least two of the plurality of ledge ring partitions define portions of a first stage segment radially inboard of an adjacent second stage segment; and an extraction aperture located flush with an inner surface of one of the first stage segment or the second stage segment.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
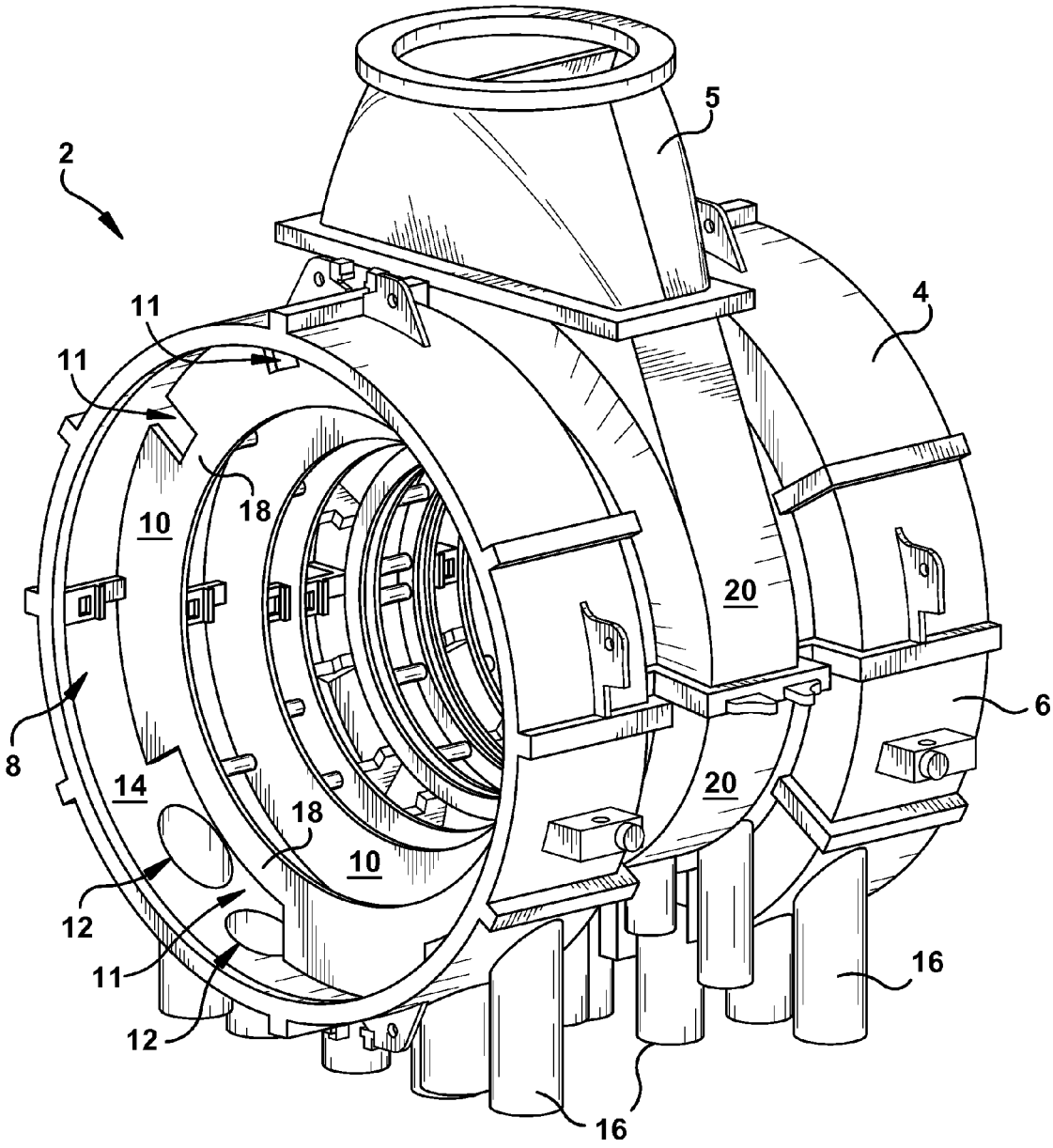
FIG. 1 shows a three-dimensional perspective view of a turbine casing section according to embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Aspects of the invention provide for a turbine casing segment, e.g., a steam turbine casing segment including ledge ring partition aperture (or, cutout), allowing for a flush (or continuous, or uninterrupted) interface with an extraction conduit. One particular aspect of the invention provides for a turbine casing segment having an extraction aperture and a corresponding extraction conduit, each with substantially identical inner diameters.

As noted herein, conventional turbine casing segments (e.g., in low-pressure, or LP, steam turbine casing segments) include built-up interfaces, commonly referred to as extraction boxes, for connecting extraction conduits to the casing segment. These extraction boxes have distinct inner dimensions (e.g., length and width) from the extraction conduits to which they are connected. In some turbine applications, incorporating extraction boxes into the turbine casing may be impracticable. For example, in some cases, extraction boxes may occupy an undesirable amount of space in the casing segment, and may complicate the fabrication of the casing segment. Additionally, in some designs, it is desirable to integrate additional extraction conduits, and the use of extraction boxes may violate spacing constraints in such designs.

In one aspect of the invention, a turbine casing segment is disclosed. This turbine casing segment can include: a plurality of stage segments; a plurality of ledge ring partitions separating the plurality of stage segments, wherein at least one of the plurality of ledge ring partitions has an axially extending aperture therethrough; and a substantially rounded extraction aperture located flush with an inner surface of one of the plurality of stage segments. In a second aspect of the invention, a turbine casing segment is disclosed, including: a plurality of stage segments; a plurality of ledge ring partitions separating the plurality of stage segments, wherein a first one of the plurality of ledge ring partitions has an axially extending aperture therethrough; an extraction aperture fluidly connected with an inner surface of one of the plurality of stage segments proximate to the axially extending aperture; and an extraction conduit fluidly connected with the extraction aperture, wherein the extraction conduit and the extraction aperture share a substantially identical inner diameter throughout a length of the extraction conduit.

A third aspect of the invention includes a turbine casing having: an upper casing segment; and a lower casing segment coupled to the upper casing segment, the lower casing segment including: a plurality of ledge ring partitions defining a plurality of stage segments, wherein at least two of the plurality of ledge ring partitions define portions of a first stage segment radially inboard of an adjacent second stage segment; and an extraction aperture located flush with an inner surface of one of the first stage segment or the second stage segment. In this embodiment, ledge ring partitions may define a distinct fluid channel, radially inboard of the casing inner surface (or, wall).

In contrast to conventional turbine casing segments, which employ extraction boxes, aspects of the invention provide for turbine casing segments having an extraction aperture located flush with an inner surface of one of the turbine stage segments. This extraction aperture may be a continuous extension of an extraction conduit configured to extract a working fluid (e.g., steam) from the turbine casing. One aspect of the invention allowing for these flush extraction apertures (and corresponding conduits) is the implementation of ledge ring partitions (or, stage partitions) having apertures, or cutouts extending axially therethrough. These cutouts allow for the placement of extraction apertures flush against the inner surface of the turbine casing and spanning axially between two of the turbine stages.

Turning to FIG. 1, a three-dimensional perspective view of a turbine casing section (e.g., a steam turbine casing section) 2 is shown. As shown, the turbine casing section 2 may include an upper casing segment 4 (having a steam inlet 5) and a lower casing segment 6, joined at a horizontal joint surface (labeling omitted). Lower casing segment 6 includes a plurality of stage segments 8 (also shown in FIG. 2) and a plurality of ledge ring partitions 10 (several shown) separating the plurality of stage segments 8. As disclosed herein, and in contrast to conventional turbine casing segments, the ledge ring partitions 10 may include one or more apertures (or, passageways, or cutouts) 11 which may extend axially therethrough, when the ledge ring partitions 10 are positioned in the casing section 2. In some embodiments, the ledge ring partitions 10 may partially define at least partially circumferentially extending channels (e.g., channel 13, best seen in FIG. 2) radially inboard of an adjacent stage segment 8, as is discussed further herein. Additionally, the ledge ring partitions 10 including apertures (or, cutouts) 11 may allow the casing segment (e.g., casing segment 6) to employ substantially flush extraction apertures 12 extending radially between two stages of the casing, in axially extending passageways radially outboard of the at least partially circumferentially extending channels 13. These extraction apertures 12 (several shown) may be substantially rounded, and may be located flush with an inner surface 14 of one of the plurality of stage segments 8. In one embodiment (shown), the extraction aperture 12 may be a substantially rounded aperture, however, in alternative embodiments, the extraction aperture 12 may take a variety of shapes (e.g., substantially oval, squared, polygonal, etc.). In another aspect of the invention, the turbine casing segment 6 may include an extraction conduit 16 (several shown) fluidly connected with the extraction aperture 12, where the extraction conduit 16 and the extraction aperture 12 share a substantially identical inner diameter throughout a length (e.g., a radial length) of the extraction conduit 16.

Figure 2:
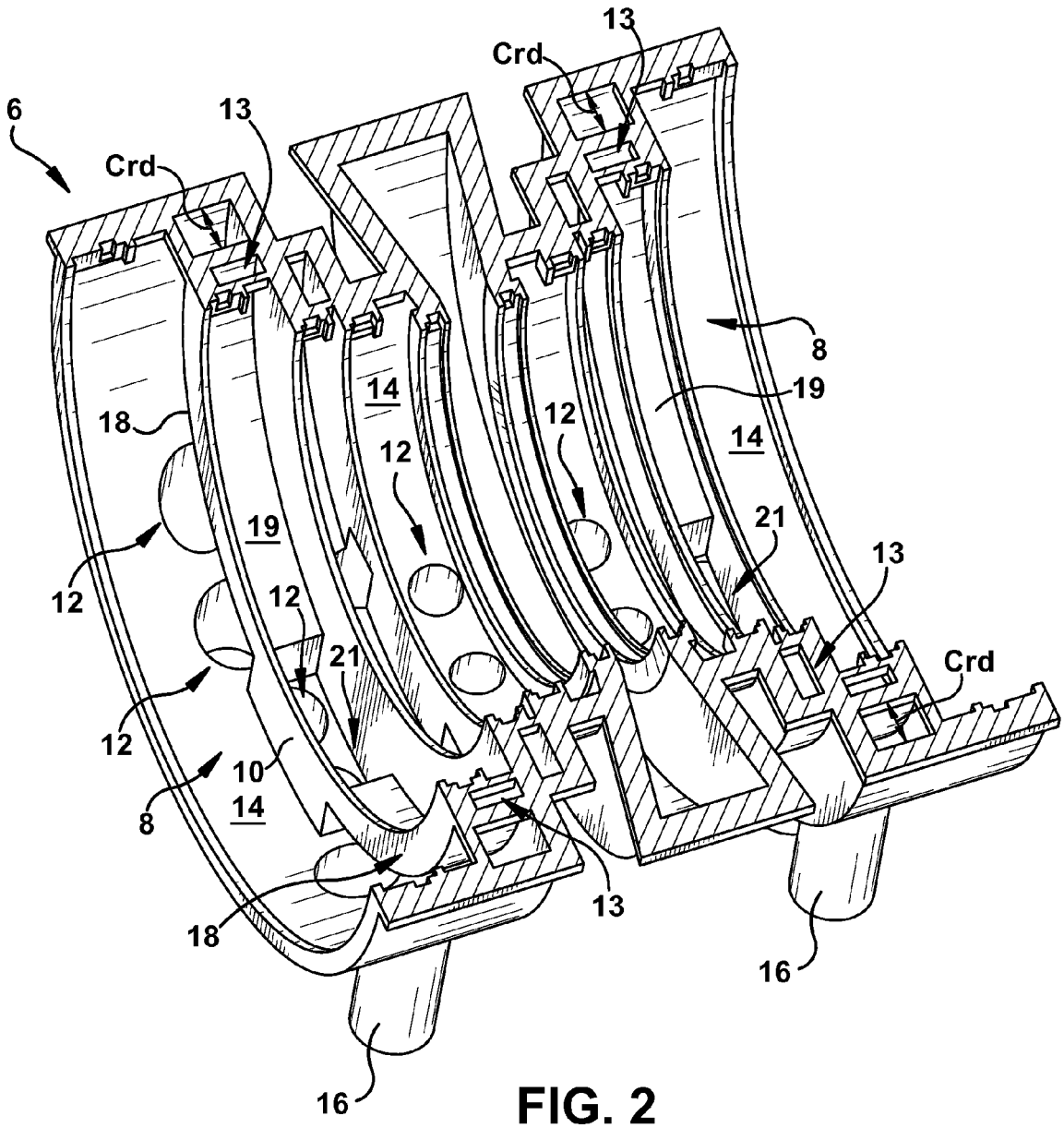
FIG. 2 shows a three-dimensional top perspective view of a turbine casing segment according to embodiments of the invention.
Figure 3:
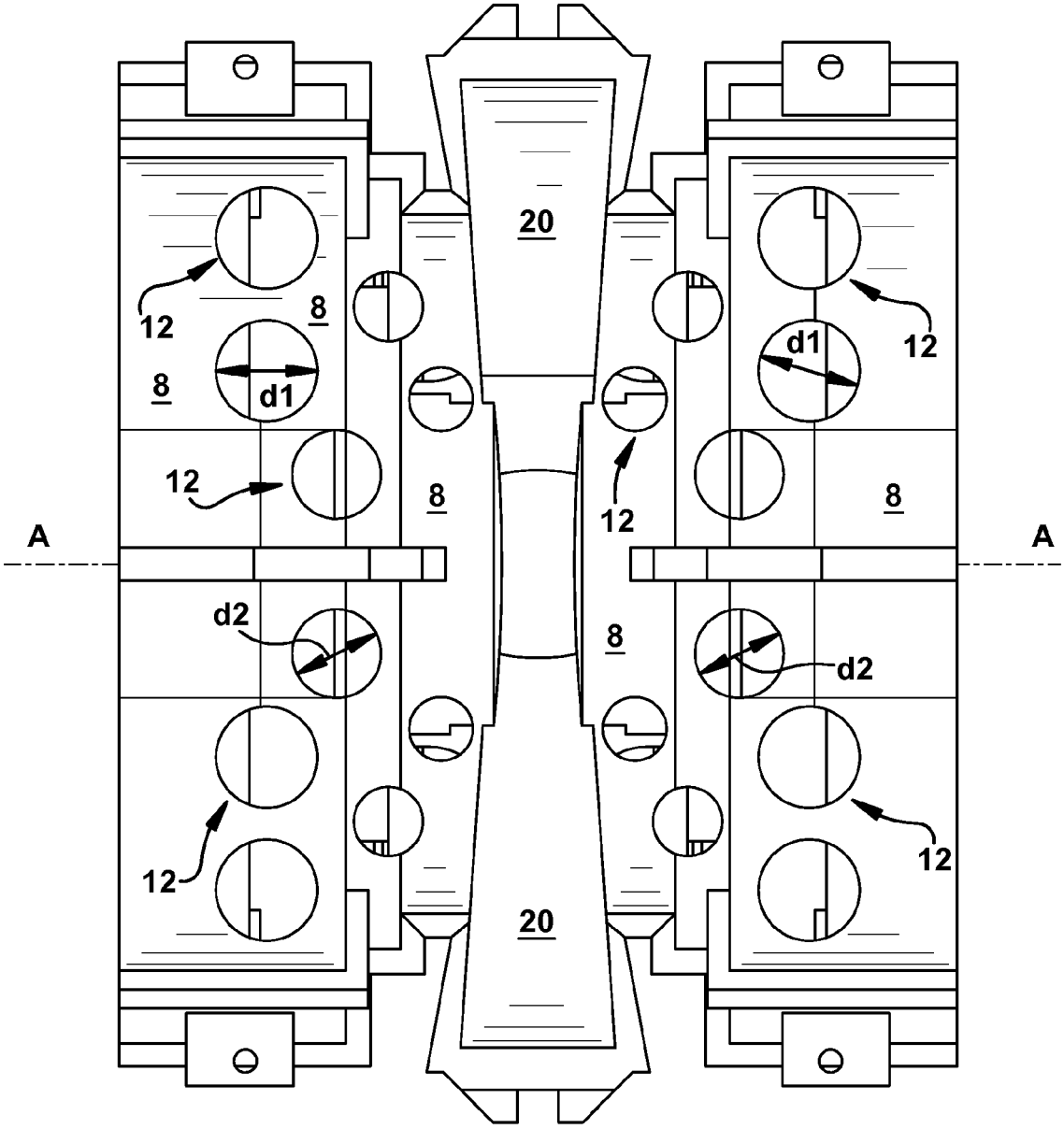
FIG. 3 shows a bottom view of a turbine casing segment according to embodiments of the invention.

FIGS. 2-3 show a three-dimensional top perspective view, and a bottom view, of the turbine casing segment 6 of FIG. 1, respectively. FIGS. 2-3 more clearly illustrate the interaction between the extraction aperture 12, the extraction conduit 16, and the inner surface 14 of stage segment 8. That is, as can be seen from the perspective view of FIG. 2 and the bottom view of FIG. 3, in one aspect of the invention, an extraction conduit 16 has an extraction aperture 12 with a common (e.g., substantially identical) inner diameter (d1 or d2). That is, for each respective extraction conduit 16, there exists a corresponding extraction aperture 12 having a substantially identical inner diameter (e.g., d1 or d2). The inner diameter (d1 or d2) of each respective extraction aperture 12 and extraction conduit 16 pair may vary across regions of the turbine casing segment, e.g., where aperture/conduit pairs at the lower pressure stages (farther from the inlet stage 20) may have larger diameters (e.g., d1) than aperture/conduit pairs at the higher pressure stages (e.g., d2). As can be seen in particular in FIG. 3, extraction apertures 12 (and corresponding conduits 16) may span axially between at least two of the stages 8 of the turbine casing segment 6. That is, in contrast to conventional extraction "boxes," the extraction apertures 12 and extraction conduits 16 may span between more than one stage 8 of the turbine casing segment 6. Additionally, as shown in FIG. 2 (and also seen in FIG. 1), the ledge ring partitions 10 having apertures (or, cutouts) 11, include sections 18 located radially inward and separated from the inner surface 14 of the stage segments 8. That is, sections 18 of the ledge ring partitions 10 may be radially separated from the inner surface 14 of the stage segments 8, thereby allowing for open, or uninterrupted extraction apertures 12 flush with the inner surface 14 of the stage segments 8. In one embodiment, sections 18 of the ledge ring partitions 10 may be separated from the inner surface 14 of the stage segments 8 by a distance of approximately 8-10 inches or more. This distance (also known as the radial depth, Crd, of the cutout 11) may be dictated by the steam path within a particular portion of the turbine. That is, the radial depth (Crd) of each cutout 11 may vary within one ledge ring partition 10, depending upon whether the cutout 11 is in the upper casing segment 4 or the lower casing segment 6. Additionally, the radial depth (Crd) of each cutout 11 may vary between distinct ledge ring partitions 10, depending upon the turbine stage. Further, as is visible in FIG. 2, the radial depth (Crd) of each cutout 11 corresponds to the distance that the circumferential passageway 13 is off-set from the inner surface 14 of the stage segment 8. These at least partially circumferentially extending channels 13 may further be defined by inner walls 19, radially inboard of the inner surfaces 14, which in some embodiments, extend only partially circumferentially with the lower turbine casing segment 6. In some embodiments, these at least partially circumferentially extending channels 13 are fluidly connected with an extraction aperture 12, which may be located, e.g., in a well region (or, well) 21. It is understood that in some cases, the extraction apertures 12 located in the well region may be fluidly isolated from the extraction apertures located flush with the inner surfaces 14 by the ledge ring partitions 10.

In any case, it is understood that aspects of the invention provide for ledge ring partitions 10 having apertures, or cutouts, 11, which allow for extraction conduits 16 that directly contact the inner surface of the turbine stage segments (e.g., the inner surface 14 of lower casing segment 6). Due to the design of the ledge ring partitions, additional extraction conduits (and extraction apertures) may be integrated into the design of the lower casing segment (as compared to the conventional designs), such that a desired amount of steam may be extracted from the lower casing segment without the use of extraction "boxes." It is understood that conventionally, casing segments may be fabricated (e.g., by fabricating from one or more pieces of material such as a metal), and that reducing the complexity of that fabrication process may improve the end-product yield, and reduce costs. As compared with the conventional extraction box configuration, aspects of the invention may reduce the complexity of fabricating turbine casing segments (e.g., turbine casing segment 6). For example, aspects of the invention may reduce the complexity of fabricating a turbine casing segment (e.g., turbine casing segment 6) because the extraction conduit and extraction aperture have substantially identical inner diameters (thereby eliminating an interface step, or ledge). Additionally, without the additional fabricating required for an extraction "box" (as in conventional casing segments), fabricating of the turbine casing segment 6 disclosed herein may reduce costs and complexity. Even further, additional steam may be extracted from the turbine casing segment 6 employing extraction apertures 12 and conduits 16 that can span axially between more than one casing segment 8.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine casing segment comprising:

a plurality of stage segments;

a plurality of ledge ring partitions separating the plurality of stage segments, wherein at least one of the plurality of ledge ring partitions has an axially extending aperture therethrough; and a substantially rounded extraction aperture located flush with an inner surface of one of the plurality of stage segments, wherein the substantially rounded extraction aperture spans axially between at least two of the plurality of stage segments.

2. The turbine casing segment of claim 1, further comprising an extraction conduit fluidly connected with the substantially rounded extraction aperture.

3. The turbine casing segment of claim 2, wherein the extraction conduit has a substantially identical inner diameter as an inner diameter of the substantially rounded extraction aperture.

4. The turbine casing segment of claim 2, wherein the extraction conduit has a substantially identical inner diameter along its length.

5. The turbine casing segment of claim 1, wherein the substantially rounded extraction aperture is configured to allow for extraction of steam from the turbine casing segment.

6. The turbine casing segment of claim 1, further comprising an additional extraction aperture having a substantially rounded portion, the additional extraction aperture located flush with an inner surface of a second one of the plurality of stage segments.

7. A turbine casing segment comprising:

a plurality of stage segments;

a plurality of ledge ring partitions separating the plurality of stage segments, wherein a first one of the plurality of ledge ring partitions has an axially extending aperture therethrough;

an extraction aperture fluidly connected with an inner surface of one of the plurality of stage segments proximate to the axially extending aperture; and an extraction conduit fluidly connected with the extraction aperture, wherein the extraction conduit and the extraction aperture share a substantially identical inner diameter throughout a length of the extraction conduit, wherein the extraction aperture spans axially between at least two of the plurality of stage segments.

8. The turbine casing segment of claim 7, wherein a second ledge ring partition adjacent to the first one of the plurality of ledge ring partitions has an axially extending aperture therethrough, the first ledge ring partition and the second ledge ring partition partially defining a stage segment among the plurality of stage segments radially inboard of an adjacent stage segment among the plurality of stage segments.

9. The turbine casing segment of claim 8, wherein the extraction aperture is substantially rounded and is configured to allow for extraction of steam from the turbine casing segment.

10. The turbine casing segment of claim 8, further comprising an additional extraction aperture having a substantially rounded portion, the additional extraction aperture located flush with an inner surface of a second one of the plurality of stage segments.

11. A turbine casing comprising:

an upper casing segment; and a lower casing segment coupled to the upper casing segment, the lower casing segment including:

a plurality of ledge ring partitions defining a plurality of stage segments, wherein at least two of the plurality of ledge ring partitions define portions of a first stage segment radially inboard of an adjacent second stage segment;

an extraction aperture located flush with an inner surface of the first stage segment, an at least partially circumferential fluid channel separated from the inner surface of the second stage segment, the extraction aperture fluidly connecting the at least partially circumferential fluid channel with an extraction conduit; and a fluid well located radially inboard of the extraction aperture and fluidly connected with the at least partially circumferential fluid channel.

12. The turbine casing of claim 11, further comprising an extraction conduit fluidly connected with the extraction aperture.

13. The turbine casing of claim 12, wherein the extraction conduit has a substantially identical inner diameter as an inner diameter of the extraction aperture.

14. The turbine casing of claim 11, wherein the extraction conduit spans axially between a portion of the first stage segment and the second stage segment.

15. The turbine casing of claim 11, wherein the extraction aperture is configured to allow for extraction of steam from the turbine casing segment.

* * * * *

UNITED STATES PATENT AND TRADEMARK OFFICE

CERTIFICATE OF CORRECTION

PATENT NO. : 8,790,080 B2
APPLICATION NO. : 13/102647
DATED : July 29, 2014
INVENTOR(S) : Gonoor et al.

It is certified that error appears in the above-identified patent and that said Letters Patent is hereby corrected as shown below:

In the Claims

In Column 6, Line 27, in Claim 10, delete “claim 8,” and insert -- claim 7, --, therefor.

Signed and Sealed this
Twenty-sixth Day of May, 2015

Michelle K. Lee

Michelle K. Lee
*Director of the United States Patent and Trademark Office*